US007913866B2

(12) United States Patent
Bodenbender

(10) Patent No.: US 7,913,866 B2
(45) Date of Patent: Mar. 29, 2011

(54) CREAM POT

(76) Inventor: Manfred Bodenbender, Marburg (DE)

( * ) Notice: Subject to any disclaimer, the term of this patent is extended or adjusted under 35 U.S.C. 154(b) by 181 days.

(21) Appl. No.: 12/090,558

(22) PCT Filed: Oct. 19, 2006

(86) PCT No.: PCT/EP2006/010093

§ 371 (c)(1),
(2), (4) Date: Jul. 17, 2008

(87) PCT Pub. No.: WO2007/045474

PCT Pub. Date: Apr. 26, 2007

(65) Prior Publication Data

US 2009/0039080 A1 Feb. 12, 2009

(30) Foreign Application Priority Data

Oct. 21, 2005 (DE) ..... 10 2005 050 896

(51) Int. Cl.
*B65D 21/02* (2006.01)
*B65D 1/24* (2006.01)
*A47J 27/00* (2006.01)

(52) U.S. Cl. ..... 220/23.89; 220/23.87; 220/23.83; 220/526; 220/573.4; 220/573.5

(58) Field of Classification Search ..... 220/23.89, 220/23.87, 23.83, 526, 573.4, 573.5, 573.1, 220/912; 62/457.2; 99/403, 345, 359
See application file for complete search history.

(56) References Cited

U.S. PATENT DOCUMENTS

| | | | | |
|---|---|---|---|---|
| 2,842,301 | A * | 7/1958 | Albert | 229/400 |
| 3,036,374 | A * | 5/1962 | Williams | 228/108 |
| 4,651,397 | A * | 3/1987 | Martin Saint Leon | 29/243.517 |
| 4,951,832 | A * | 8/1990 | Tenney et al. | 220/23.83 |
| 5,515,990 | A * | 5/1996 | Popeil et al. | 220/23.86 |
| 6,035,906 | A * | 3/2000 | Ott | 141/312 |
| 6,352,168 | B1 * | 3/2002 | Lin | 220/592.17 |
| 6,540,132 | B1 * | 4/2003 | Lowry et al. | 229/117.12 |
| 6,610,339 | B1 * | 8/2003 | Borgerson | 426/120 |
| 7,337,518 | B2 * | 3/2008 | Cheng | 29/505 |
| 7,374,117 | B2 * | 5/2008 | Lin et al. | 241/273.3 |
| 2009/0039080 | A1 * | 2/2009 | Bodenbender | 220/23.83 |

FOREIGN PATENT DOCUMENTS

| | | |
|---|---|---|
| CH | 676 784 | 3/1991 |
| DE | 29 39 664 | 4/1981 |
| DE | 2 181 108 | 4/1987 |
| DE | 20 2004 011 963 | 12/2004 |
| FR | 2 796 044 | 1/2001 |

OTHER PUBLICATIONS

International Search Report corresponding to PCT/EP2006/010093 under date of mailing of Feb. 26, 2007.

* cited by examiner

*Primary Examiner* — Anthony Stashick
*Assistant Examiner* — Kareen Rush
(74) *Attorney, Agent, or Firm* — Quarles & Brady LLP

(57) ABSTRACT

The invention relates to a cream pot (10) for receiving a cream or the like, said pot consisting of an outer pot (11), an inner pot (14), and a connection device for connecting a lid element thereto. The inner pot consists of plastic, is inserted into a receiving element of the outer pot, and comprises a metal wall lining a receiving region (37).

9 Claims, 2 Drawing Sheets

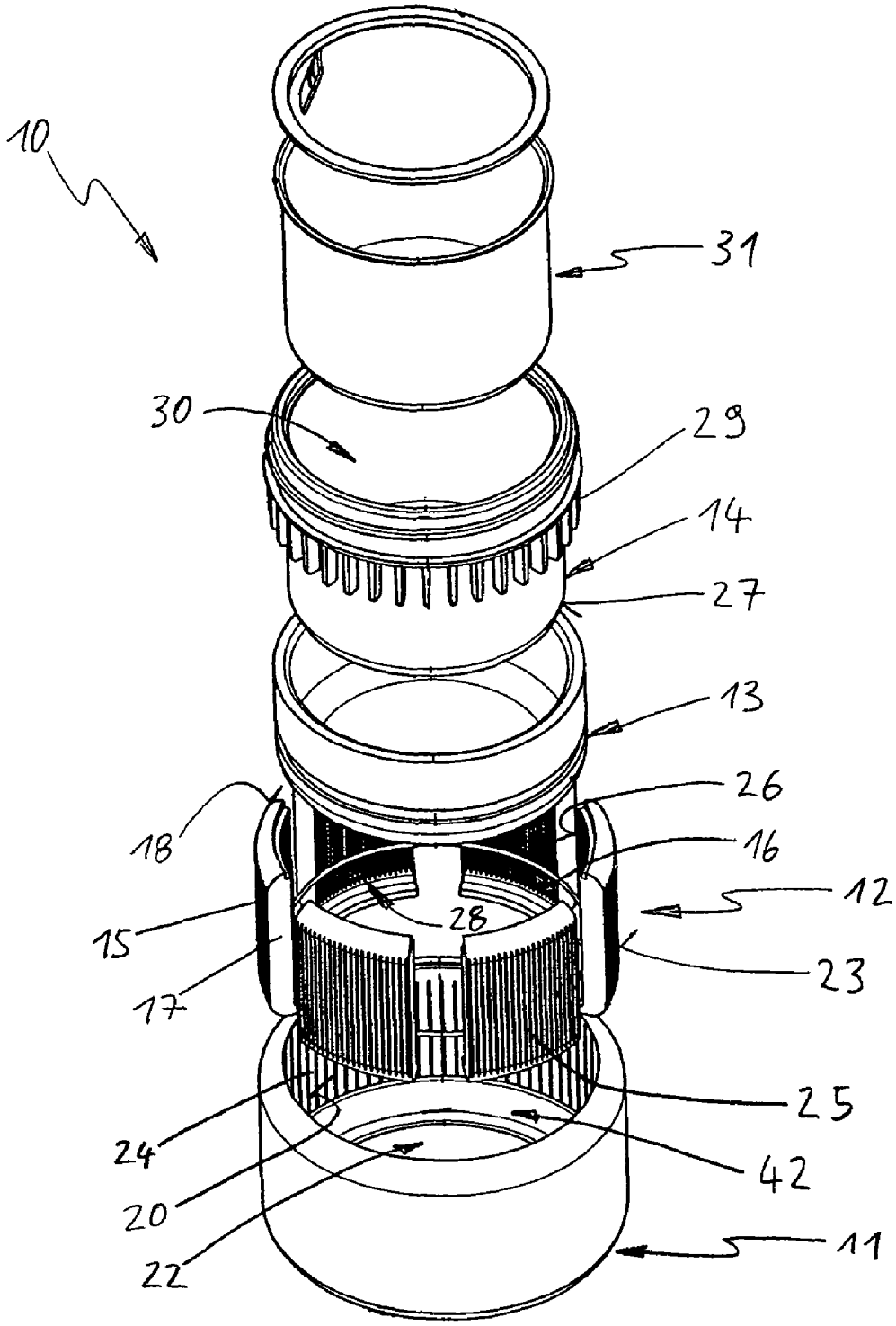
FIG..1

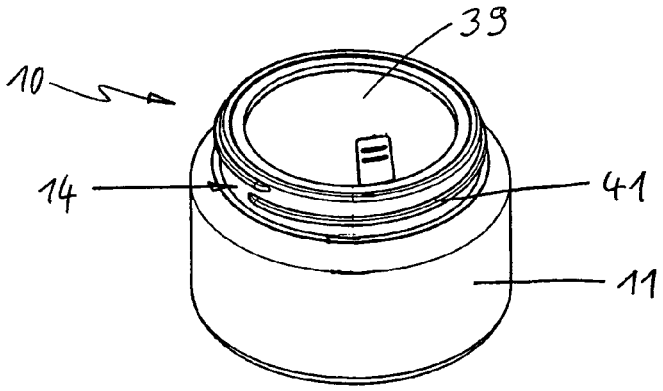
FIG..2
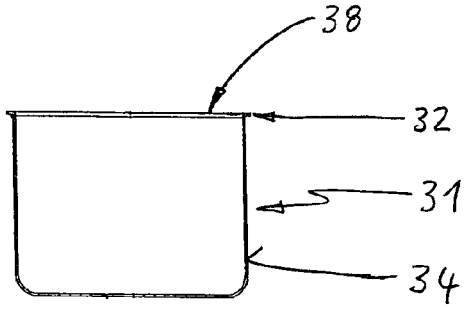
FIG..3
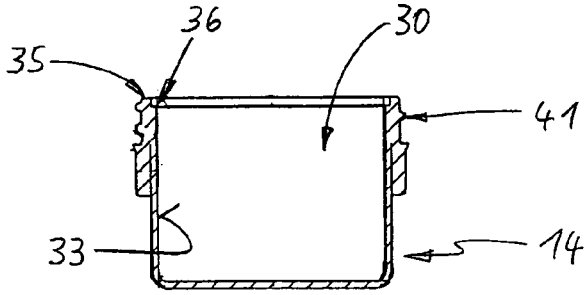
FIG..4
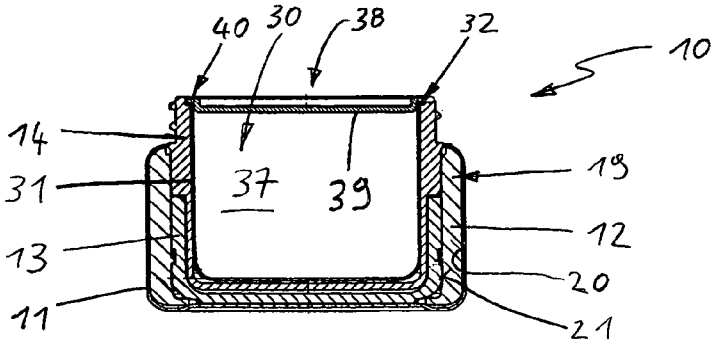
FIG..5

CREAM POT

The invention relates to a cream pot for receiving a cream or the like, with an outer pot and an inner pot, and a connection device for connecting a lid device, wherein the inner pot is made of plastic, is inserted in a receiving device of the outer pot, and has a metal wall lining a receiving area.

Cream pots of the kind mentioned at the outset are used to receive cream, in particular skin cream, and intended to enable the safe storage of the received cream on the one hand and an aesthetic presentation of the latter on the other. In particular with respect to the more pricey skin creams, emphasis is placed on a correspondingly high-quality packaging of the cream pot. It has since also become commonplace to combine various materials in making cream pots. Plastics are often used to fabricate the inner pot, and metal materials, such as aluminum in particular, are used to fabricate the outer pot. Especially high-end packaging designs also use inner pots made out of glass, in which a plastic insert is interspersed in an outer pot comprised of aluminum.

In such a design for a cream pot, in particular the glass inner pot does impart the impression of especially high quality, even though combining three different materials, i.e., metal, plastic and glass, results in correspondingly complicated logistics in conjunction with preparing the components, which are generally fabricated at various manufacturing sites. The costs of manufacturing the glass inner pot are also relatively high as opposed to the components made of plastic. Such a cream pot consisting of three different materials also is especially difficult to recycle owing to the variety of materials.

Therefore, the object to this invention is to propose a cream pot, which imparts the impression of especially high quality in terms of its packaging on the one hand, but is comparatively cost-effective to manufacture by comparison to the use of glass, along with being safe and easy to handle and recycle.

This object is achieved by the cream pot according to the invention for receiving a cream or the like by having it exhibit an outer pot, an inner pot and a connection device for connecting a lid device, wherein the inner pot is made of plastic, and has a metal wall lining a receiving area.

The structural design of the inner pot according to the invention makes it possible to forego the use of glass as the material for manufacturing the inner pot. Rather, the combination of plastic inner pot with a metal liking imparts the impression that the inner pot is made out of glass. This effect can be traced back in particular to the fact that the temperature of a metal surface is routinely perceived as being lower than temperature of a plastic surface given the same ambient temperature, as is also the case for glass surfaces. Further, the only materials that require recycling are plastic and metal, which simplifies recycling of the cream pot. The manufacturing costs for a plastic inner pot with metal wall are also comparatively lower than those for a glass inner pot. The cream pot is generally safer to handle, since breaking glass will be the result of dropping the cream pot, thereby precluding the risk of injury as the result of splintering pieces of glass.

It is especially advantageous for the metal wall of the inner pot to consist of a metal coating applied to the inner pot. Such a coating is very thin, and hence particularly inexpensive to manufacture. It is very easy to form various surface structures, for example a matte or shiny metal surface. For example, if the connection device of the inner pot for connecting the lid device consists of a screwed connection in the form of a thread or roves, the thread or grooves can also be readily provided with a metal coating, so that the inner pot as a whole exhibits a metal surface. Various methods known to the expert are available for this purpose.

In another embodiment, the metal wall of the inner pot can consist of a metal pot insert that can be in placed into the inner pot. This is especially advantageous just for the reason that basically the same method used for fabricating a metal outer pot can be used to manufacture the metal insert for the plastic inner pot. In addition, this further improves the ability to recycle the cream pot, since the metal can be easily separated from the plastic of the inner pot.

If the outer pot has a metal wall, it can be completely made out of metal, for example. It is also possible to make the outer pot of plastic, and provide it with a metal coating. The metal coating can be applied both to the exterior of the outer pot, and to the interior of the outer pot. In this way, various effects relating to the visual and tactile impression of the outer pot can be achieved.

This also makes it possible to manufacture a cream pot using as few disparate fabrication techniques as possible, for example a thermoforming process for making the metal outer pot and pot insert for the inner pot, and an injection molding process for making the plastic inner pot.

It is especially advantageous for the lid device to have a metal wall, since essentially the same method for manufacturing an outer pot can be used to fabricate the lid device. The lid device can also be designed to resemble the outer pot in this way.

In one embodiment, the receiving device of the outer pot can be designed as a receiving element that can preferably be completely inserted into the outer pot. The outer pot can be manufactured with an outer diameter that is comparably greater than the outer diameter of the inner pot, since the gap between the outer pot and inner pot can be filled by the receiving element. The inner pot can then be easily placed into the receiving element of the receiving device of the outer pot. In addition, the use of a receiving element and resultant ability to design the outer pot with a larger diameter make it possible to design a cream pot with a relatively large overall volume, wherein the volume of the receiving area of the inner pot need not be increased. Designing the outer pot in this way can positively influence a decision to purchase with an eye toward the profitability of an expected content.

In another embodiment, the receiving element can have at least one twisting safeguard, which is designed as a grooved structure in the longitudinal direction, and engages in a matching twisting safeguard of the outer pot and/or inner pot. This makes it particularly easy to prevent the inner pot from twisting relative to the receiving element, or the outer pot from twisting relative to the receiving element, if the lid device is secured to the inner pot via twisting, or removed from the inner pot. In addition, it is easy to ensure a more reliable grip between the components by setting up an interference fit between the flanks of the grooves. In particular, this enables a reduction in the costs for assembling the cream pot, since the components can be inserted one into the other, and cannot be readily detached from each other given proper use due to the surface pressure between the groove flanks. Component recycling is also simplified, since adhesives need not be used for attachment purposes during assembly.

The receiving element is particularly easy to place into the outer pot if the receiving element consists of segments. In addition, the outer pot can be designed to have a smallest opening diameter less than its greatest inner wall diameter. If the receiving element consists of a composite of radially movable segments, the latter can be moved to an assembly position that permits the insertion of the receiving element through a relatively small opening in the outer pot. Finally, the segments can be radially expanded into an end position, wherein the segments come to abut the inner wall diameter of the outer pot. In this way, the formation of a beaker-shaped outer pot with a larger inner wall diameter that deviates from the opening diameter of the outer pot, without having to refrain from using a receiving element.

It is especially advantageous for a weight element to be incorporated into the outer pot, preferably completely. For example, the weight element can be situated between the inner pot and receiving element, and consist of diecast zinc or another metal. The weight element imparts a higher intrinsic weight to the cream pot, making it possible to subjectively impute the use of valuable materials and a greater volumetric content, imparting the overall impression of a high-quality packaging of the cream pot.

In an advantageous embodiment, the lid device has a cover element for covering the receiving area. The lid device can serve as a transport guard on the one hand, which prevents ingredients from getting a lid wet, and as a film, e.g., connected with the inner pot, which seals the filled inner pot and signals the integrity of the content.

One particularly valuable impression for the cover element is achieved by making the cover element out of a metal that corresponds to the metal in the metal wall of the inner pot. This also simplifies recycling of the components given the use of the same metals.

A drawing will be used below to describe an advantageous embodiment of the cream pot.

Shown on:

FIG. 1: is an exploded and perspective view of a cream pot;

FIG. 2: is a perspective view of the cream pot shown on FIG. 1 in an assembled state;

FIG. 3: is a pot insert for placement in an inner pot of the cream pot shown on FIGS. 1 and 2;

FIG. 4: is a longitudinal sectional view of an inner pot for receiving the pot insert shown on FIG. 3;

FIG. 5: is a longitudinal sectional view of the cream pot shown on FIG. 2.

FIG. 1 shows an exploded view of a cream pot 10. The cream pot 10 comprises an outer pot 11 that is preferably made out of a single piece of metal, for example aluminum, and used to receive a receiving element designed as an expansion sleeve 12, a weight element 13 and an inner pot 14, as also depicted on FIG. 5, which shows the aforementioned parts after assembled.

The expansion sleeve 12 depicted on FIG. 1 in a radially expanded state has six expansion segments 15, which are interconnected on their interior periphery by means of a flexible, annular holding element 16. For purposes of assembly, meaning to introduce the expansion sleeve 12 into a receiving area 42 of the outer pot 11, the expansion segments 15 are abutted against each other on their longitudinal edges 17, 18, so that the expansion sleeve 12 correspondingly reduced in its periphery can be placed in the outer pot 11 through an insertion opening 22 therein, and then be returned to its expanded state for receiving the weight element 13, so that, as shown on FIG. 5, a pot gap 19 between an inner wall 20 of the outer pot 11 and an outer wall 21 of the weight element 13 is essentially filled by the expansion sleeve 12. In this state, the inner pot 14 can now be put in from above via introduction into the insertion opening 22 of the outer pot 11.

As evident from FIG. 1, the inner wall 20 of the outer pot 11 along with the outer walls 23 of the expansion segments 15 is provided with a grooving 24 or 25, which enables a toothed relative engagement to provide a safeguard against twisting between the outer pot 11 and expansion sleeve 12. Affixed to the inner walls 26 of the expansion segments 15 along with an outer wall 27 of the inner pot 14 is a grooving 28 or 29, which permits a toothed meshing to establish a twisting safeguard between the expansion sleeve 12 and inner pot 14.

As also evident form FIGS. 1 and 5, a pot insert 31 to be received in an inner area 30 of the inner pot 14 (FIG. 4) is provided as a lining metal wall of the inner pot 14, and in the present case is designed to resemble a beaker, as shown in particular on FIG. 3, with a flange-like beaker edge 32 formed on the upper edge. In order to receive the pot insert 31, the inner pot 14 depicted on FIG. 4 is provided with an inner wall 33 essentially corresponding to the contour of an outer wall 34 of the pot insert 31. Further, the front wall 35 of the inner pot 14 has an edge projection 36, against which the pot insert 31 comes to rest with its beaker edge 32 during assembly, as shown on FIG. 5.

To close off a receiving area 37 of the pot insert 31, an access opening 38 of the pot insert 31 is provided with a cover element, which is designed as a cover disk 39, and a flange edge 40 of it abuts the beaker edge 32 of the pot insert 31.

A screw cap (not shown in greater detail) is provided to seal the cream pot 10 depicted on FIGS. 2 and 5, and can be screwed onto an external thread 41 formed below the front edge 35 of the inner pot 14.

In the exemplary embodiment of the cream pot 10 depicted here, both the outer pot 11 and pot insert 31 of the inner pot 14 are made out of aluminum. The expansion sleeve 12 and inner pot 14 both consist of a plastic material that can preferably be subjected to an injection molding process. Just as the outer pot 11, pot insert 31 and cover disk 39, the weight insert 13 consists of metal, in particular aluminum. For example, the weight insert 13 can be made out of diecast zinc.

The invention claimed is:

1. A cream pot for receiving a cream, said cream pot comprising:

an outer pot having a receiving device;

a plastic inner pot received in said receiving device, said inner pot defining a receiving area for receiving the cream;

a metal wall lining said receiving area for receiving the cream; and a connection device for connecting a lid device;

in which the receiving device of the outer pot is a receiving element that can be placed in the outer pot, the receiving element has at least one twisting safeguard, which is a grooved structure in the longitudinal direction, the outer pot has at least one twisting safeguard, and the inner pot has at least one twisting safeguard, wherein the twisting safeguard of the receiving element meshes with the twisting safeguards of the outer pot and the inner pot to prevent twisting of the inner pot relative to the outer pot.

2. The cream pot according to claim 1, in which the metal wall of the inner pot consists of a metal coating applied to the inner pot.

3. The cream pot according to claim 1, in which the metal wall of the inner pot consists of a metal pot insert that can be introduced into the inner pot.

4. The cream pot according to claim 1, in which the outer pot exhibits a metal wall.

5. The cream pot according to claim 1, in which the lid device covering the receiving area of the inner pot exhibits a metal wall.

6. The cream pot according to claim 1, in which the receiving element consists of segments.

7. The cream pot according to claim 1, in which a weight element is incorporated in the outer pot.

8. The cream pot according to claim 1, in which the lid device has a cover element for covering the receiving area.

9. The cream pot according to claim 8, in which the cover element is made of a metal corresponding to the metal of the metal wall of the inner pot.

* * * * *